US008726479B2

(12) United States Patent
Kufferath-Kassner et al.

(10) Patent No.: US 8,726,479 B2
(45) Date of Patent: May 20, 2014

(54) WOVEN FABRIC COMPRISING WEFT WIRES

(75) Inventors: Ingo Kufferath-Kassner, Düren (DE); Jakob Sistig, Nideggen (DE); Christoph Kronhagel, Bonn (DE); Ralf Müller, Much (DE)

(73) Assignee: GKD—Gebr. Kufferath AG, Dueren (DE)

( * ) Notice: Subject to any disclaimer, the term of this patent is extended or adjusted under 35 U.S.C. 154(b) by 152 days.

(21) Appl. No.: 13/199,989

(22) Filed: Sep. 14, 2011

(65) Prior Publication Data

US 2012/0023729 A1 Feb. 2, 2012

Related U.S. Application Data

(62) Division of application No. 12/084,813, filed as application No. PCT/DE2006/001926 on Nov. 3, 2006, now Pat. No. 8,056,586.

(30) Foreign Application Priority Data

Nov. 8, 2005 (DE) ..... 10 2005 053 521
Mar. 6, 2006 (DE) ..... 10 2006 010 582

(51) Int. Cl.

| | |
|---|---|
| ***B23P 11/00*** | (2006.01) |
| ***D03D 13/00*** | (2006.01) |
| ***D03D 15/00*** | (2006.01) |
| ***D03D 27/02*** | (2006.01) |

(52) U.S. Cl.

USPC ..... 29/428; 139/383 R; 139/405; 139/408; 428/221; 428/223

(58) Field of Classification Search

USPC ..... 428/221, 223, 257, 178, 188; 139/425 A, 383 A, 410, 39, 44, 403, 139/383 R, 46, 402, 405, 408, 426 TW; 245/2, 10, 1, 18; 162/348, 903, DIG. 1; 29/428, 896.6, 896.61, 897.15, 433

See application file for complete search history.

(56) References Cited

U.S. PATENT DOCUMENTS 903,595 A * 11/1908 Margerison et al. ..... 139/396
1,611,660 A * 12/1926 Manly ..... 473/159

(Continued)

FOREIGN PATENT DOCUMENTS

CN 2416129 1/2001
DE 24 32 908 1/1975

(Continued)

OTHER PUBLICATIONS

International Search Report of PCT/DE2006/001926, Mar. 19, 2007.

(Continued)

*Primary Examiner* — Essama Omgba
(74) *Attorney, Agent, or Firm* — Collard & Roe, P.C.

(57) ABSTRACT

A woven fabric includes warp threads or wires and includes weft wires, wherein, the woven fabric includes an offset weft wire. The offset is particularly suitable for fastening objects separate from the woven fabric. A method uses the woven fabric as a facade hanging by using the woven fabric as a base structure for bearing an object separate from the woven fabric. The object is borne on the offset separate from the woven fabric.

17 Claims, 2 Drawing Sheets

(56) References Cited

U.S. PATENT DOCUMENTS

| | | | | | |
|---|---|---|---|---|---|
| 1,999,044 | A | * | 4/1935 | Frank | 139/402 |
| 2,107,719 | A | | 2/1938 | Ferdinand | |
| 2,355,789 | A | | 8/1944 | Faber | |
| 2,555,789 | A | * | 6/1951 | Durham | 150/143 |
| 2,571,077 | A | * | 10/1951 | Underwood et al. | 139/403 |
| 2,685,894 | A | | 8/1954 | Parlin | |
| 2,717,005 | A | * | 9/1955 | Hoeselbarth | 139/39 |
| 2,758,613 | A | * | 8/1956 | Schmitz | 139/39 |
| 3,154,459 | A | * | 10/1964 | Cranston | 428/91 |
| 3,167,281 | A | | 1/1965 | Hill | |
| 3,441,063 | A | * | 4/1969 | Naimer et al. | 139/391 |
| 3,895,786 | A | | 7/1975 | Eysn | |
| 4,249,653 | A | | 2/1981 | Kufferath-Kassner | |
| 4,404,999 | A | * | 9/1983 | Woodall et al. | 139/391 |
| 4,554,953 | A | * | 11/1985 | Borel et al. | 139/383 A |
| 4,592,396 | A | | 6/1986 | Borel et al. | |
| 5,158,171 | A | * | 10/1992 | Graff | 198/848 |
| 5,232,759 | A | * | 8/1993 | Golze | 428/89 |
| 5,542,527 | A | | 8/1996 | Jakob | |
| 5,651,641 | A | * | 7/1997 | Stephens et al. | 405/302.6 |
| 5,843,542 | A | | 12/1998 | Brushafer et al. | |
| 5,950,807 | A | * | 9/1999 | Greer | 198/850 |
| 7,072,567 | B2 | | 7/2006 | Hammers | |
| 7,077,362 | B2 | | 7/2006 | Edelmeier | |
| 7,530,994 | B2 | * | 5/2009 | Thistle | 623/1.13 |
| 8,056,586 | B2 | * | 11/2011 | Kufferath-Kassner et al. | 139/383 R |
| 8,209,843 | B2 | * | 7/2012 | Thistle | 29/433 |
| 2002/0107569 | A1 | | 8/2002 | Katsura | |
| 2003/0226938 | A1 | | 12/2003 | Edelmeier | |

FOREIGN PATENT DOCUMENTS

| | | | | |
|---|---|---|---|---|
| DE | 25 32 908 | | | 2/1976 |
| DE | 2907487 | A | * | 8/1980 |
| EP | 0 478 925 | | | 4/1992 |
| EP | 1 428 458 | | | 6/2004 |
| EP | 1 486 598 | | | 12/2004 |
| RU | 2 202 663 | | | 6/2002 |
| RU | 2 240 388 | | | 11/2004 |
| WO | WO 03/031292 | | | 4/2003 |

OTHER PUBLICATIONS

English translation of Chinese Office Action dated Dec. 18, 2009 in Chinese Application No. 200680050636.0.

* cited by examiner

Fig. 4
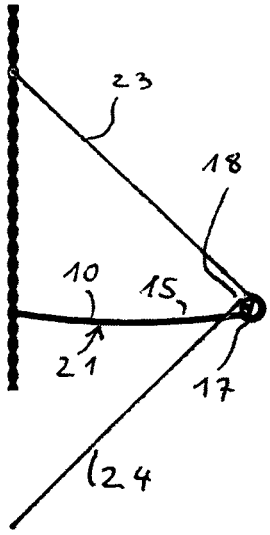
Fig. 3
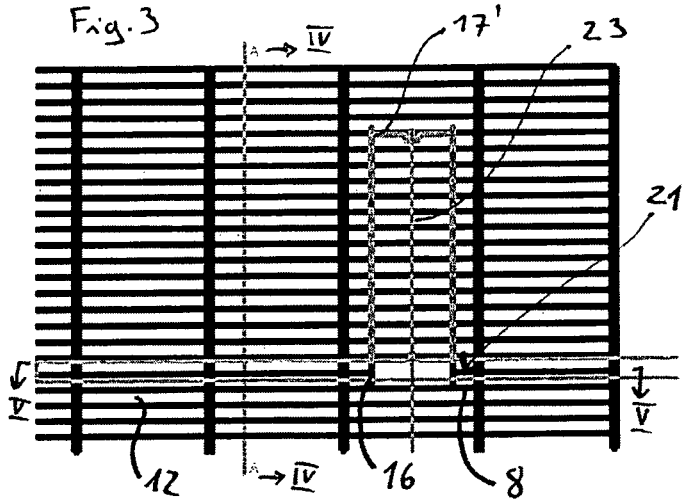
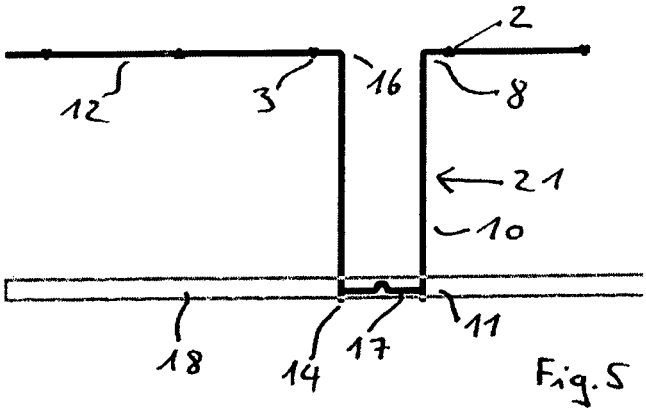
Fig. 5
Fig. 6
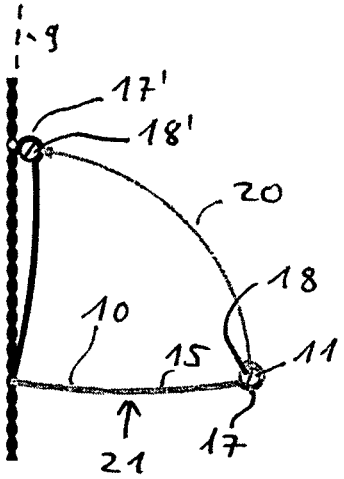

WOVEN FABRIC COMPRISING WEFT WIRES

CROSS REFERENCE TO RELATED APPLICATIONS

This application is a divisional of and Applicant claims priority under 35 U.S.C. §§120 and 121 of parent U.S. patent application Ser. No. 12/084,813, filed Oct. 10, 2008 , now U.S. Pat. No. 8,056,586, which application is a national stage application under 35 U.S.C. §371 of PCT/DE2006/001926 filed on Nov. 3, 2006, which claims priority under 35 U.S.C. §119 of German Application No. 10 2005 053 521.6 filed on Nov. 8, 2005 and German Application No. 10 2006 010 582.6 filed Mar. 6, 2006, the disclosures of each of which are hereby incorporated by reference. The international application under PCT article 21(2) was not published in English.

BACKGROUND OF THE INVENTION

1. Field of the Invention

The invention relates to a woven fabric comprising weft wires. In particular, the invention relates to an all-metal woven fabric comprising weft wires.

2. The Prior Art

Woven fabric, in particular metal woven fabric, is being used for increasingly varied tasks. A usage very much in demand recently is as a facade cladding for buildings. Frequently, separate objects are placed on the woven fabric. In the case of facade cladding, these can, for example, be support rods with LEDs or other light sources which are either aligned so that they illuminate the woven fabric or direct light away from the woven fabric. In other cases of application, water pipes are fastened to the woven fabric, for example, in order to achieve a decorative effect with water trickling down in pearls on the woven fabric. In addition, decorative elements, loudspeakers and a multiplicity of other objects can be fastened to the woven fabric.

The fastening of objects on the woven fabric is not always easy and frequently requires a large amount of work time which makes a woven fabric provided with objects very expensive to install. In most cases, an attempt is made to place an object to be fastened to the woven fabric either directly on to the woven fabric and then fix it with fastening wires. If the object is not intended to abut directly against the nonwoven fabric, it has hitherto been regarded as unavoidable to first fix a holder on the woven fabric which projects outwards. The actual object can then be fastened to its projecting end. All the previously known methods are therefore relatively expensive.

SUMMARY OF THE INVENTION

It is the object of the invention to provide an improvement compared with the prior art.

This object is achieved by a woven fabric comprising warp threads or wires and comprising weft wires, wherein the woven fabric has an offset weft wire. The wire in the woven fabric is particularly well suited for fastening objects of any kind as a result of the strength inherent in a wire. The weft wire can therefore advantageously be selected for this task both in a woven fabric having no metal components apart from the wire and also in an all-metal woven fabric. Whereas conventional weft wires run at least substantially one-dimensionally, the invention makes it possible to achieve a considerably easier connection of objects to the weft wire. By specifically shaping the offset region of the weft wire, in particular wire regions can be created which are particularly well suited for clipping on an object or at least are more easily accessible and reachable for manual fastening.

The threads or wires can be made of any materials. However, metal or plastic is preferred. Monofilament or multifilament wires are suitable depending on the intended use.

The offset in the weft wire can in particular be U-shaped. A U-shaped offset is mechanically particularly easy to produce and forms a bracket which projects from the non-offset part of the weft wire. This is particularly suitable for fastening objects thereon.

The aforesaid is achieved to a particular extent if the offset comprises at least two, in particular four, right angles. Thus, the first deflection in the course of the weft wire can in particular take place by a right angle so that the weft wire is guided out from the woven fabric perpendicular to its remaining direction of progress, is there bent with two further right angles to form a U-shape and then dips back into the woven fabric at a right angle.

Regardless of its precise shape, however, it is advantageous if the offset projects from the woven fabric. In this way, it is more easily accessible both for manual and for mechanical connections.

The extent by which the offset projects from the woven fabric depends on numerous circumstances. Firstly, it is important how stable the weft wire is and what load it is intended to bear in the operating state. The designated function can also predefine suitable dimensions. This is the case, for example, when supports for light sources which floodlight the woven fabric are to be arranged at the tips of the protruding offsets in the woven fabric. In order to be able to illuminate a large area of the woven fabric for given light-emission scattering angles of the light sources, a very large distance can be required from the plane of the woven fabric. Thus, in many cases it can be advantageous if the offset guides the weft wire further out from the woven fabric than the distance between two warp threads, in particular possibly by more than twice the distance between two warp threads.

From the production technology point of view, it is advantageous if the offset lies in the course of the weft wire, that is between two warp threads and not at the edge of the woven fabric. If the offset lies in the woven fabric, both the leg of the weft wire guiding this out from the woven fabric and also that leg guiding said weft wire back into the woven fabric can rest statically on the respectively next warp threads. On the other hand, the offset would tend to twist easily under loading if it were arranged at the edge of the woven fabric.

The woven fabric is particularly stable if the offset lies between two immediately adjacent warp threads.

In order that a woven fabric of the proposed type can be stored and transported before its final usage location in a space-saving and easy-to-handle manner, it is proposed that the offset weft wire should be turned about an axis defined by its portion located in the woven fabric and can thus be laid completely flat onto the woven fabric. In this way, it is possible to roll up the woven fabric like a conventional woven fabric. During the rolling-up, the offset can be laid flat and rolled up into the roll without resulting in an excessively large increase in the volume of the woven fabric roll.

It is understood that the woven fabric can already be advantageously used with an offset. In particular, however, it can also have a multiply offset weft wire and/or a plurality of offset weft wires. In this case, the offsets can be uniformly spaced apart along the weft wire, likewise the plurality of offset weft wires. In these ways, the bearing capacity for objects is perceptibly increased in a simple manner.

In order to be able to fix two offsets at an angle to one another and/or to the woven fabric after installing the woven fabric, it is proposed that a tension thread is provided. The tension thread can in particular run along all the offsets of the woven fabric which are lined up linearly with respect to one another so that if necessary, a plurality of tension threads are provided. Ideally, each offset has a fastening with a tension thread. After installing the woven fabric, the individual offset weft wires then only need to be turned or bent into their desired position; when the tension thread is then fastened to all the offsets and the tension thread is fixed in particular outside the woven fabric or at the edge of the woven fabric as far as possible under tensile stress, the offsets are protected from any undesired turning about then non-offset sections located in the woven fabric. In addition, such a fastening by means of a tension thread increases the bearing capacity.

It is understood that the object forming the basis of the invention is also achieved by a method for producing a woven fabric comprising warp threads or wires and comprising weft wires, wherein in the loom the warp thread is fanned by a fan dimension to allow the weft wire to pass through when the weft wire is provided with an offset and is then guided further in its original axis, wherein the offset has a smaller dimension than the fan dimension. It can be seen immediately that such a method of producing the woven fabric leads to a woven fabric of the type described previously. In this case, it is mechanically easily possible to execute the offset within the fanned warp threads so that the actual weaving process is completely uninfluenced by the offset in the weft wire. In this case, the offset can easily guide the weft wire almost as far from its axis as the warp thread is fanned in the loom. For example, if the fan dimension in the loom is 20 cm, it is easily possible to fix the offset of the weft wire at 19 cm.

If a previously described woven fabric is used as the base structure for bearing an object separate from the woven fabric, it is proposed that the object is borne on the offset. It has already been explained that the offset is particularly easily accessible for fastening the objects and as a result of the possible distance from the plane of the woven fabric for particular functions, brings with it further advantages, for example, when the object comprises an electronically drivable light source which is to be used, for example, to illuminate the woven fabric.

In accordance with the explanations already given previously, the object is also achieved by a method for installing a building cladding with media-reproducibly interlinked light sources, wherein a woven fabric of the type described previously is first suspended on the building and then supports for the light sources are fastened to the offsets, in particular are clipped to these. In this case, an all-metal woven fabric is particularly suitable as a building cladding. This can also be used particularly advantageously in relation to its light reflections as soon as interlinked light sources, in particular interlinked LEDs are provided, which reproduce photos or films via a triggering electronic system. If the light source supports are merely clipped on the offsets, i.e., fastened to these by means of a latching mechanism, the light source supports can be exchanged subsequently particularly easily if these should be defective.

In addition, in accordance with the explanations already given previously, the object is also achieved by a method for rolling a woven fabric of the preceding type, wherein the offset lies flat to the woven fabric during rolling up. A woven fabric rolled up in such a manner can then be transported in a particularly space-saving manner to its subsequent location of use, for example, to a building where it is to form the cladding. After unrolling, the offsets can then be pivoted again into the desired position relative to the plane of the woven fabric.

Offset wires on conveyor belts or in filter fabrics are mentioned as further applications.

The invention is explained in detail hereinafter by means of an exemplary embodiment with reference to the drawings. In this context, the same or functionally the same components can have identical reference numerals. In the figures

BRIEF DESCRIPTION OF THE DRAWINGS

FIG. 3 shows a detail of the plan view from FIG. 1 with an offset in the weft wire, FIG. 4 shows a side view of the detail in FIG. 3 according to the characterisation IV-IV there, FIG. 5 shows a schematic view from above of the detail from FIG. 3 according to the characterisation V-V there and FIG. 6 shows a side view from FIG. 4 with the offset weft wire in a folded-out and in a laid-flat position.

DETAILED DESCRIPTION OF THE PREFERRED EMBODIMENTS

Figure 2:
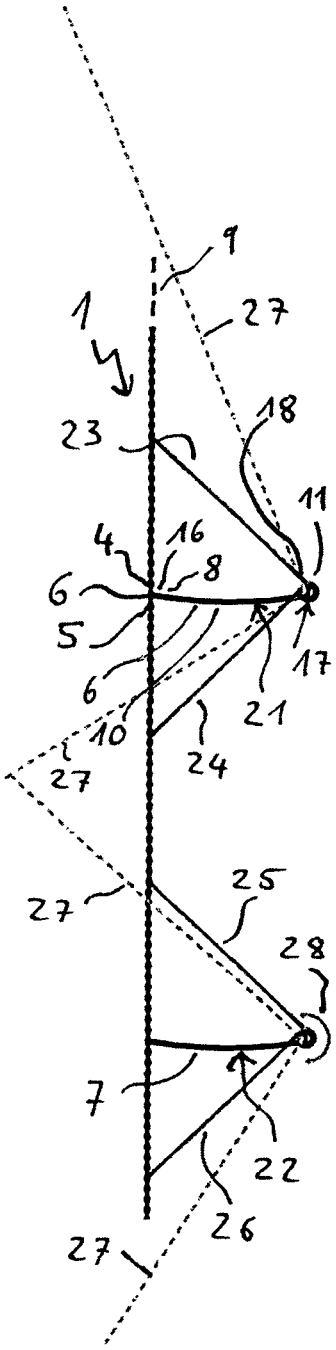
FIG. 2 shows a side view of the woven fabric from FIG. 1 according to the characterisation II-II there.

The metal woven fabric 1 in FIGS. 1 to 6 substantially spatially consists of metal warp threads (denoted as an example with 2, 3) and conventional weft wires (denoted as an example with 4, 5).

However, the metal woven fabric 1 differs from a conventional woven fabric in that at those positions at which weft wires 4, 5 would still be found at a regular spacing in a conventional woven fabric, two offset weft wires 6, 7 are present in the woven fabric here. Like the conventional weft wires 4, 5, the offset weft wires 6, 7 are integrated in the woven fabric 1 and are thus held by the warp threads 2, 3.

In the course of each offset weft wire 6, 7, however, the weft wire is offset by 90° at a first position 8 (only shown as an example on the weft wire 6) and leads from there out from a woven fabric plane 9. The weft wire 6 is slightly curved in its course 10 but proceeds continuously approximately at right angles to the woven fabric plane 9 from said plane.

At a distinct distance from the woven fabric plane 9 the offset weft wire 6 is bent again substantially at right angles at a second position 11 and now continues substantially parallel to its original course 12 and to the woven fabric plane 9. However, before it has bridged a field width 13 between the neighbouring warp threads 2, 3, it is again bent by 90° at a third position 14 and leads back alongside the course 10 parallel thereto in a course 15 (covering the leading-out course 10) back to the woven fabric plane 9. There the weft wire 6 is again offset by 90° at a fourth position 16 and now continues its original course 12 in the remaining woven fabric.

At the second right angle 11 and at the third right angle 14, the weft wire 6 is not simply bent as at the right angles 8 and 16 but is bent slightly in such a manner that a visible U-contoured groove 17 is obtained in the transverse viewing direction according to FIGS. 2, 4 and 6. At least one partially translucent tube 18 is pressed into each groove 17. The tubes 18 are fitted with light emitters, preferably with light-emitting diodes. These can be switched on and off individually via a central control. Cable to the LEDs or to other electronic components or other light emitters can be accommodated inconspicuously in the tubes 18 and thus, for example, guided to the edge of the woven fabric 1.

In this way, the metal woven fabric 1 can be specifically illuminated statically and dynamically with the aid of the LEDs in the tubes 18. Light-emitting diodes or other light emitters are preferably provided in the colours red, green and blue (preferably in the ratio 2:2:1) so that the woven fabric 1 can be illuminated in a large number of colours. If the ratio of the observer distance to the fineness of the grid of lamps or the support tubes 18 and support offsets 10, 17, 15 required for this purpose is sufficiently large, a static or moving picture can thus be produced for the observer.

It can be seen that the offset weft wires 6, 7 can be easily pivoted almost up to a right angle about their regions 12 running in the woven fabric plane 9, i.e. as far as a position in which the brackets 21, 22 lie almost flat on the remaining woven fabric. Such a position is illustrated in FIG. 6. The U-shaped bracket head 17 carries the tube 18 with the LEDs in a folded-out position of the bracket 21 and can easily be pivoted jointly with said bracket along a pivot path 20 into a transport position completely flat on the woven fabric plane 9 (17', 18'). In this position the entire woven fabric 1 can be rolled up like a conventional woven fabric and despite the protruding brackets 21, 22 of the offset weft wires 6, 7, only a slight increase in the volume of a woven fabric roll is obtained.

In order to fix the supporting brackets 21, 22 in their pivoted-out position for operation, two tension cables 23, 24, 25, 26 are fastened to the woven fabric 1, each leading to the bracket 17 and being likewise fixed there. The tension cables 23, 24 or 25, 26 form a triangle in side view in relation to the woven fabric plane (cf. FIGS. 2, 4) so that any deflection of a supporting bracket 21, 22 or clamping bracket 17 immediately sets one of the tension cables 23 or 24 and/or 25 or 26 respectively under tension and thereby held in the folded-out position. A guide groove is provided on the bracket 17 for fixing the tension cables 23, 24, 25, 26, preferably at the centre of the bracket as shown in FIG. 5.

In the folded-out position, in a suitable configuration the respective light sources in the support tubes 18 project a large light cone (limits characterised by the reference numerals 27) towards the woven fabric 1. At the same time, the tubes can easily be turned about their longitudinal axis (shown by the turning arrow 28) so that the light cone 27 of the light emitters can be individually adapted to any support tube 18. At the same time, the clamping brackets 17 can be designed so that they securely fix the tubes 18 in their alignment for operation by the mere engaging or clamping force.

In detail the warp threads 2, 3 are each formed as wire cables grouped in threes.

Figure 1:
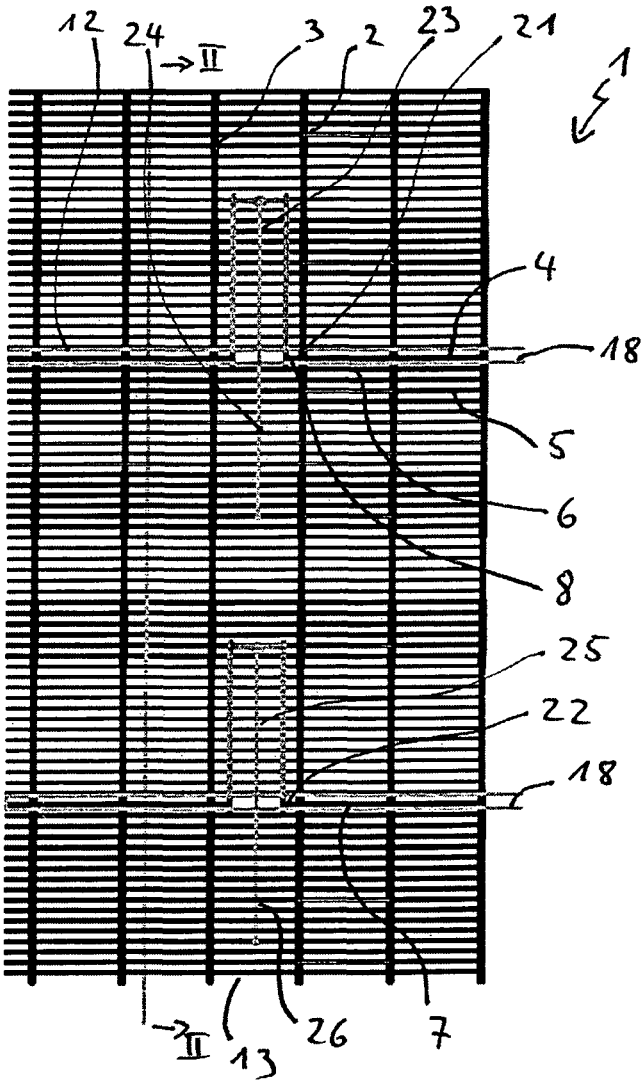
FIG. 1 shows schematically a plan view of an all-metal woven fabric with two offset weft wires.

It should be noted that the woven fabric view in FIGS. 1 and 2 can only represent a section from a larger woven fabric. The invention is particularly meaningful for those woven fabrics in which each illuminant tube 18 is held by at least two offsets 21 or 22 along a weft wire 6 or 7. However, the invention is not restricted to such applications.

The precise fastening of the tubes or other objects separate from the woven fabric at the tip of the U-shaped supporting brackets 21, 22 can be effected in manifold ways, for example, in addition to the clamping or engagement shown, also by means of small metal wires, plastic clips or other means.

What is important for the invention is that a continuously producible woven fabric has support structures protruding from the woven fabric plane, i.e. the offset brackets.

It should also be noted that the tension cables not only fulfil their function when they directly connect respectively one supporting bracket to the remaining woven fabric but also when tension cables are attached between supporting brackets, in which case only one, preferably two, brackets need be fixed in their pivot angle. A tension cable can again be used for this purpose which, at these positions, leads from the tension bracket to the remaining woven fabric or to the edge of the woven fabric. The tension wire cables can in particular be fixed at the edge of the woven fabric on supporting rods there under tension.

In use, the woven fabric according to the invention can be produced and appropriately used in various orders of magnitude, starting from a small decorative woven fabric mat, for example, in window size as far as claddings for entire building facades which can even extend over entire high-rise buildings, wherein, as has already been indicated previously, tubes can be used as objects to be supported, which are specifically supplied with current via multimedia control electronics so that light sources integrated therein emit coloured light either towards the woven fabric and/or away from the woven fabric. This first variant is particularly suitable for immersing the woven fabric in colour effects which can also change over time. The second variant is particularly suitable for presenting a static and/or dynamic picture to a far-removed observer when the resolution of the light sources is suitably dense. For example, advertising films or art films can be observed in this way on a building facade.

What is claimed is:

1. A method of using a woven fabric as a facade hanging, the method comprising steps of:

(a) providing a woven fabric comprising warp threads or wires and comprising weft wires, and further comprising an offset weft wire;

(b) using the woven fabric being used as a base structure for bearing an object separate from the woven fabric, the object being borne on the offset separate from the woven fabric;

wherein a plurality of offset wires is provided in the woven fabric, each of the offset weft wires comprising at least one offset section protruding from the woven fabric and non-offset sections located in the woven fabric, wherein the offset weft wires can be turned about respective axes defined by non-offset portions of the offset weft wires located in the woven fabric, so that protruding offset sections can be laid completely flat on the woven fabric, wherein a tension thread fixes two offset sections protruding from the woven fabric at an angle to one another, to the woven fabric, or to one another and to the woven fabric, so that the tension thread protects the protruding offset sections from any undesired turning about the non-offset sections located in the woven fabric and so that a bearing capacity for objects carried separate from the woven fabric at respective tips of the protruding offset sections is increased.

2. The method according to claim 1, wherein the object comprises an electronically controllable light source.

3. A method for installing a facade hanging for a building with media-reproducibly interlinked light sources, wherein at least one woven fabric comprising warp threads or wires and comprising weft wires, and comprising an offset weft wire, is suspended on the building facade, and then supports of the light sources are fastened to the offsets in order to enable the method according to claim 1.

4. The method according to claim 3, wherein the supports of the light sources are clipped on the offsets.

5. A method for preparing the installation of a woven fabric with an offset weft wire as a facade hanging according to the method of claim 1, the woven fabric being rolled for transportation purposes, wherein the offset is laid flat to the fabric during rolling.

6. The method according to claim 1, wherein the offset is U-shaped.

7. The method according to claim 1, wherein the offset comprises at least one right angle.

8. The method according to claim 1, wherein the offset guides the weft wire further out from the woven fabric than the distance between two warp threads.

9. The method according to claim 1, wherein the offset lies in the course of the weft wire between two warp threads.

10. The method according to claim 9 wherein the offset lies between two adjacent warp threads.

11. The method according to claim 1, wherein the offset weft wire is turned about an axis defined by its portion located in the woven fabric and thus can be laid completely flat on the woven fabric.

12. The method according to claim 1, wherein the woven fabric further comprises a repeatedly bent weft wire.

13. The method according to claim 1, wherein the woven fabric further comprises a plurality of offset weft wires.

14. The method according to claim 1, wherein the offsets or the offset weft wires are uniformly spaced.

15. The method according to claim 1, wherein a tension thread is provided which fixes two offsets at an angle to one another and/or to the woven fabric.

16. The method according to claim 1, wherein the woven fabric is metal.

17. The method according to claim 1, wherein the at least one offset comprises a guide groove, and wherein the object is fixed into the guide groove and the at least one offset bears the object.

* * * * *